US005079211A

United States Patent [19]

Shimura et al.

[11] Patent Number: 5,079,211

[45] Date of Patent: Jan. 7, 1992

[54] HEAT SENSITIVE RECORDING MATERIAL

[75] Inventors: Yutaka Shimura; Toshimitsu Nakajima; Shigetoshi Hiraishi, all of Tokyo, Japan

[73] Assignee: Mitsubishi Paper Mills Limited, Tokyo, Japan

[21] Appl. No.: 419,843

[22] Filed: Oct. 11, 1989

[30] Foreign Application Priority Data

Oct. 12, 1988 [JP] Japan ..... 63-257632

[51] Int. Cl.[5] ..... B41M 5/30

[52] U.S. Cl. ..... 503/217; 503/216; 503/218; 503/221

[58] Field of Search ..... 503/216–218, 503/208, 209, 214, 225; 427/150–152

[56] References Cited

U.S. PATENT DOCUMENTS 4,824,824 4/1989 Matsushita et al. ..... 503/204
4,880,767 11/1989 Hiraishi .

FOREIGN PATENT DOCUMENTS 0156250 10/1985 European Pat. Off. ..... 503/217
60-262686 12/1985 Japan ..... 503/217
61-110586 5/1986 Japan ..... 503/217

OTHER PUBLICATIONS

European Search Report and Annex to the European Search Report, 08/08/90.

*Primary Examiner*—Bruce H. Hess
*Attorney, Agent, or Firm*—Cushman, Darby & Cushman

[57] ABSTRACT

The present invention provides a heat sensitive recording material which is less in fog in background area and has superior color toning effect with high image storage stability which contain a fluoran compound represented by the following formula in addition to an aromatic isocyanate compound and an imino compound having at least one >C=NH group which forms color upon application of heat:

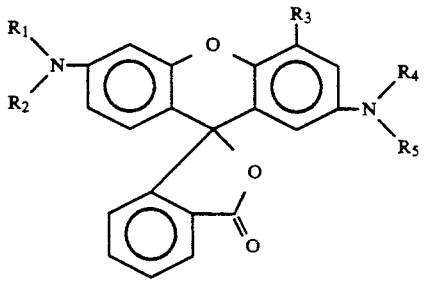

wherein $R_1$, $R_2$ and $R_3$ each represents a hydrogen atom, a lower alkyl group, a cyclohexyl group or an allyl group and $R_4$ and $R_5$ each represents a hydrogen atom, a lower alkyl group, a phenyl group, a cyclohexyl group or an aralkyl group. This heat sensitive recording material may further contain a heat fusible substance and/or a phenol compound to further improve heat responsivity or anti-fogging properties of background portion.

7 Claims, No Drawings

HEAT SENSITIVE RECORDING MATERIAL

BACKGROUND OF THE INVENTION

1. Field of the Invention

The present invention relates to improvement of color toning of a heat sensitive recording material excellent in image storage stability.

2. Prior Art

In general, a heat sensitive recording material comprises a support and, provided thereon, a heat sensitive recording layer mainly composed of an electron-donating colorless dye precursor and an electron-accepting color developer and when this is heated by a thermal head, a thermal pen, laser beam, and the like, the colorless dye precursor and the color developer react instantaneously to produce a recorded image. Such is disclosed in Japanese Patent Kokoku Nos. 43-4160 and 45-14039. Such heat sensitive recording materials have the merits that recording can be performed by relatively simple devices, maintenance is easy and no noise is generated and are used in various fields such as recorders for meaurement, facsimile, printers, terminals for computers, labels and vending machines for tickets, etc.

Such heat sensitive recording materials which utilize electron-donating colorless dye precursor and electron-accepting color developer have various excellent properties that they have good appearance and are good to the touch and yield high coloring density and various hue, but they suffer from the problems that if colored portion (recorded image portion) contacts with plastic articles such as polyvinyl chloride, the portion disappears due to plastisizer or additives contained in the plastics, or if the portion contacts with chemicals contained in foods or cosmetics, it easily disappears or the portion is readily discolored upon exposure to light for a short period, namely, they are inferior in storage stability of record. Owing to these problems, they are limited in use and improvements on this point has been much demanded.

As heat sensitive recording materials which can provide recorded images of high storage stability by the reaction of two components upon heating, Japanese Patent Kokai Nos. 58-54085, 58-104959, 58-149388, 59-115887, and 59-115888 and U.S. Pat. No. 4,521,793 disclose heat sensitive recording materials using imino compound and isocyanate compound as the two components. These heat sensitive recording materials are superior in storage stability, but are inferior in heat responsivity and cannot give recorded image of sufficient density by a high speed printing apparatus. Furthermore, the resulting image is only of sepia color in hue.

As an approach to improve heat responsivity, the inventors reported a heat sensitive recording material containing three components of imino compound, isocyanate compound and blue color type fluoran compound in Japanese Patent Kokai No. 60-262686. This material is superior in storage stability of recorded image and heat responsivity, but is insufficient in toning effect and cannot form an image of color close to black. This has further defect that uncolored portion (background) is readily fogged.

The above heat sensitive recording material disclosed by the inventors is superior to conventional heat sensitive recording materials in image storage stability and heat responsivity, but has the problems that stability of uncolored portion is inferior (fogging in background) and hue of the image is not black color tone.

SUMMARY OF THE INVENTION

As a result of the inventors' intensive research conducted for solving these problems, it has been found that the objective heat sensitive recording material can be obtained when a fluoran compound represented by the formula:

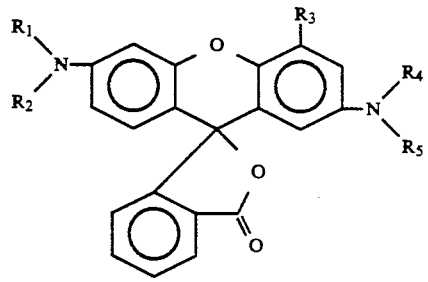

(wherein $R_1$, $R_2$ and $R_3$ each represents a hydrogen atom, a lower alkyl group, a cyclohexyl group or an allyl group and $R_4$ and $R_5$ each represents a hydrogen atom, a lower alkyl group, a phenyl group, a cyclohexyl group, or an aralkyl group) is contained in a heat sensitive recording material comprising an aromatic isocyanate compound and an imino compound having at least one $>C{=}NH$ which reacts with the isocyanate compound upon application of heat to form a color. The present invention is based on this finding.

DETAILED DESCRIPTION OF PREFERRED EMBODIMENTS

Fluoran compounds have been widely used as colorless dye precursors, but it has been found that the fluoran compounds represented by the above formula are peculiarly effective for color toning. Especially effective compounds are those which are represented by the above formula wherein $R_1$ and $R_2$ each represents a lower alkyl group, $R_3$ represents a hydrogen atom or a lower alkyl group and $R_4$ and $R_5$ each represents an aralkyl group.

The fluoran compounds used in the present invention are green type fluoran compounds and as examples thereof, mention may be made of 3-diethylamino-5-methyl-7-dibenzylaminofluoran, 3-diethylamino-7-dibenzy-laminofluoran, 3-N-ethyl-N-cyclohexylamino-7-anilinofluoran, 3-N-ethyl-N-(p-methylphenyl)amino-7-(N'-methyl-N'-phenyl amino)fluoran, 3-pyrrolidyl-7-cyclohexylaminofluoran, 3-diethylamino-7-anilinofluoran, 3-N-ethyl-N-p-methylphenylamino-7-anilinofluoran, 3-diethylamino-7-p-cyclohexylanilinofluoran, 3-diethylamino-7-(N-cyclohexyl-N-benzylamino)fluoran, and 3-cyclohexylamino-7-(N-methyl-N-p-methylphenylamino)-fluoran.

When blue color type fluoran compounds such as 3-dibutylamino-6-methoxy-7-anilinofluoran, 3-dimethylamino-6-ethoxy-7-anilinofluoran, 3-diethylamino-6-ethoxy-7-anilinofluoran and 3-dibutylamino-6-ethoxy-7-anilinofluoran are used in place of the fluoran compounds of the present invention, storage stability of background is deteriorated (fogged) and besides color toning effect is not sufficient and desired color tone cannot be obtained. Furthermore, when fluoran compounds of black color type such as 3-N-ethyl-N-isopentylamino-6-methyl-7-anilinofluoran, 3-(N-methyl-N-cyclohexylamino)-6-methyl-7-anilinofluoran, 3-diethylamino-7-m-trifluoromethylanilinofluoran, and 3-diethylamino-6-methyl-7-anilinofluoran are used, fogging of background can be improved, but color toning effect is not sufficient.

Usually, the fluoran compound of the present invention is added in an amount of at least 0.5% by weight, preferably 1–100% by weight, especially preferably 3–50% by weight of the imino compound. If the addition amount is less than 0.5% by weight, color toning effect is not sufficient and if it is more than 100% by weight, this may be economically disadvantageous.

The aromatic isocyanate compounds used in the present invention mean colorless or light-colored aromatic isocyanate compounds or hetrocyclic isocyanate compounds which are solid at room temperature and include those which are disclosed in U.S. Pat. No. 4,521,793. For example, at least one of the following is used.

2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethyl-biphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphenylamine, p-dimethylaminophenyl isocyanate, and tris(4-phenylisocyanato) thiophosphate. If necessary, these isocyanates may be used in the form of so-called blocked isocyanates which are addition compounds with phenols, lactams, oximes, etc. and furthermore may be used in the form of dimers of diisocyanates such as dimer of 1-methylbenzene-2,4-diisocyanate and trimers such as isocyanurates. Besides, they may be used as polyisocyanates adducted with various polyols.

The imino compounds having at least one >C=NH group used in the present invention are those which are represented by the formula $$\phi C{=}NH$$

(where $\phi$ represents an aromatic compound residue capable of forming a conjugated system with adjacent C=N) and are those which are colorless or light-colored compounds which are solid at room temperature. These include those which are disclosed in U.S. Pat. No. 4,521,793. Typical examples thereof are shown below. These imino compounds may be used in combination, if necessary.

3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindoline-1-one, 3-imino-6-nitroisoindolin-1-one, 3-imino-isoindolin-1-spiro-dioxolan, 1,1-dimethoxy-3-imino-isoindoline, 1,1-diethoxy-3-imino-4,5,6,7-tetrachloroisoindoline, 1-ethoxy-3-imino-isoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4b]pyrazine, 7-amino-2,3-diphenyl-5-oxopyrrolo[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4', 5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2', 5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(ypridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2', 4'-dinitrophenylhydrozone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicanoimidazolyl-2'-imino)-3-imino-5,6-dimethyl-4,7-pyradiisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-iminoisoindoline, 1-[cyano-N-(3'-methylphenyl)-carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene] -3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoyl methylene-3-iminoisoindoline, 1-(cyanobenzothiazolyl-(2')-carbamoylmethylene)-3-iminoisoindoline, 1-[(cyanobenzimidazolyl-(2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')-methylene]-3-imino-6-chloroisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradiisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindoline-1-one.

The heat sensitive recording material of the present invention comprises a support and, provided thereon, a heat sensitive recording layer which forms color upon heating as mentioned above. As the support, paper is mainly used, but various non-woven fabrics, synthetic resin films, laminated papers, synthetic papers, metal foils and composite sheets comprising combinations of them may be used depending on use. The heat sensitive recording layer may comprise a single layer or a plurality of layers of multi-layer construction. In the case of multi-layer construction, an interlayer may be provided between layers. Furthermore, a protective layer may be provided on the heat sensitive recording layer. This recording layer may be formed by coating a mixture of an aqueous dispersion of each color forming component finely powdered and a binder on a support and drying the coat. In this case, each color forming component may be contained in one layer and thus, multi-layer construction may be formed.

The heat sensitive recording material of the present invention may contain a heat fusible substance for improving heat responsivity. In this case, the substance preferably has a melting point of 60°–180° C., more preferably 80°–140° C.

As examples of the heat fusible substance, mention may be made of benzyl p-benzyloxybenzoate, stearic acid amide, palmitic acid amide, N-methylolstearic acid amide, 8-naphthylbenzyl ether, N-stearylurea, N,N'-distearylurea, phenyl 8-naphthoate, phenyl 1-hydroxy-2-naphthoate, 8-naphthol(p-methylbenzyl) ether, 1,4-dimethoxynaphthalene, 1-methoxy-4-benzyloxy-naphthalene, N-stearoylurea, 4-benzylbiphenyl, 1,2-di(m-methylphenoxy)ethane, 1-phenoxy-2-(4-chlorophenoxy)-ethane, 1,4-butanediolphenyl ether, and dimethyl terephthalate.

The heat fusible substance may be used alone or in combination of two or more and preferably is used in an amount of 10–300%, more preferably 20–250% by weight of the aromatic isocyanate compound.

The heat sensitive recording material of the present invention can further contain aniline derivatives having at least one amino group disclosed in the inventors' international patent application PCT/JP81/00300 which are further effective for preventing the background from fogging. As examples of these compounds, mention may be made of methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)-carbamoyl]aniline, p-[N-(4-aminophenyl)carbamoyl]aniline, 2-methoxy-5-(N-phenylcarbamoyl)aniline, 2-methoxy-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidinesulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)-sulfone, bis(3,4-diaminophenyl)sulfone, bis(4-aminophenyl)sulfone, bis(3-aminophenyl)sulfone, 3,4'-diaminodiphenylsulfone, 3,3'-diaminodiphenylmethane, 4,4'-ethylenedianiline, 4,4'-diamino-2,2'-dimethylbibenzyl, 4,4'-diamino-3,3'-dichlorodiphenylmethane, 3,3'-diaminobenzophenone, 4,4'-diaminobenzophenone, 1,4-bis(4-aminophenoxy)benzene, 1,3-bis(4-aminophenoxy)-benzene, 1,3-bis(3-aminophenoxy)-benzene, 9,9-bis(4-aminophenyl)fluoran, 2,2-bis(4-aminophenoxyphenyl)-propane, 4,4'-bis(4-aminophenoxy)diphenyl, 3,3',4,4'-tetraaminodiphenyl ether, 3,3',4,4'-tetraaminodiphenylsulfone, and 3,3',4,4'-tetraaminobenzophenone.

Furthermore, in order to improve antifogging properties of the area where no color is formed and heat responsivity, the following phenol compounds may be added.

N-stearyl-N'-(2-hydroxyphenyl)urea, N-stearyl-N'-(3-hydroxyphenyl)urea, N-stearyl-N'-(4-hydroxyphenyl)urea, p-stearoylaminophenol, o-stearoylaminophenol, p-lauroylaminophenol, p-butyrylaminophenol, m-acetylaminophenol, o-acetylaminophenol, p-acetylaminophenol, o-butylaminocarbonylphenol, o-stearylaminocarbonylphenol, p-stearylaminocarbonylphenol, 1,1,3-tris(3-tert-butyl-4-hydroxy-6-methylphenyl)butane, 1,1,3-tris(3-tert-butyl-4-hydroxy-6-ethylphenyl)butane, 1,1,3-tris(3,5-di-tert-butyl-4-hydroxyphenyl)butane, 1,1,3-tris(3-tert-butyl-4-hydroxy-6-methylphenyl)propane, 1,2,3-tris(3-tert-butyl-4-hydroxy-6-methylphenyl)butane, 1,1,3-tris(3-phenyl-4-hydroxyphenyl)butane, 1,1,3-tris(3-cyclohexyl-4-hydroxy-5-methylphenyl)butane, 1,1,3-tris(3-cyclohexyl-4-hydroxy-6-methylphenyl)butane, 1,1,3,3-tetra(3-phenyl-4-hydroxyphenyl)propane, 1,1,3,3-tetra(3-cyclohexyl-4-hydroxy-6-methylphenyl)propane, 1,1-bis(3-tert-butyl-4-hydroxy-6-methylphenyl)butane, and 1,1-bis(3-cyclohexyl-4-hydroxy-6-methylphenyl)-butane.

Binders used in the heat sensitive recording material of the present invention include, for example, water-soluble binders such as starches, hydroxyethylcellulose, methylcellulose, carboxymethylcellulose, gelatin, casein, polyvinyl alcohol, modified polyvinyl alcohol, styrene-maleic anhydride copolymer, and ethylene-maleic anhydride copolymer and latex type water-insoluble binders such as styrene-butadiene copolymer, acrylonitrile-butadiene copolymer and methyl acrylate-butadiene copolymer.

The heat sensitive recording layer may further contain pigments such as diatomaceous earth, talc, kaolin, calcined kaolin, calcium carbonate, magnesium carbonate, titanium oxide, zinc oxide, silicon oxide, aluminum hydroxide, and urea-formalin resin, besides higher fatty acid metallic salts such as zinc stearate and calcium stearate and waxes such as paraffin, paraffin oxide, polyethylene, polyethylene oxide, stearic acid amide, and castor wax for prevention of wear of head and sticking, dispersants such as sodium dioctylsulfosuccinic acid, ultraviolet absorbers of benzophenone type and benzotriazole type, surface active agents and fluorescent dyes.

The present invention will be explained in more detail by the following examples.

EXAMPLE 1

15 g of 1,3-diimino-4,5,6,7-tetrachloro-isoindoline was dispersed together with 60 g of 1% aqueous polyvinyl alcohol solution in a ball mill for 24 hours. Separately, 10 g of 4,4', 4''-triisocyanato-2,5-dimethoxytriphenylamine was dispersed together with 40 g of 1% aqueous polyvinyl alcohol solution in a ball mill for 24 hours. Furthermore, 2.5 g of 3-diethylamino-5-methyl-7-dibenzylaminofluoran was dispersed together with 17.5 g of 5% aqueous polyvinyl alcohol solution in a ball mill for 24 hours. These three dispersions were mixed and then to the mixture was added 150 g of 40% dispersion of calcium carbonate and thereto were further added 50 g of 30% dispersion of zinc stearate, 50 g of 20% dispersion of 2-methoxy-5-N,N-diethylsulfamoylaniline, 100 g of 20% dispersion of 2-benzyloxynaphthalene, 100 g of 10% aqueous polyvinyl alcohol solution and 55 g of water, followed by sufficient stirring to obtain a coating solution. This coating solution was coated on a base paper of 50 g/m$^2$ (basis weight) at a solid coating amount of 5.8 g/m$^2$ and supercalendered to obtain a heat sensitive recording material.

EXAMPLE 2

A heat sensitive recording material was produced in the same manner as in Example 1 except that 3-diethylamino-7-dibenzylaminofluoran was used in place of 3-diethylamino-5-methyl-7-dibenzylaminofluoran.

COMPARATIVE EXAMPLE 1

A heat sensitive recording material was produced in the same manner as in Example 1 except that 3-diethylamino-5-methyl-7-dibenzylaminofluoran was omitted.

COMPARATIVE EXAMPLES 2–4

Heat sensitive recording materials were produced in the same manner as in Example 1 except that 3-dibutylamino-6-methoxy-7-anilinofluoran (Comparative Example 2), 3-N-ethyl-N-isopentylamino-6-methyl-7-anilinofluoran (Comparative Example 3) and 3-diethylamino-6-methyl-7-anilinofluoran (Comparative Example 4) were used in place of 3-diethylamino-5-methyl-7-dibenzylaminofluoran.

(Test)

Test 1 (color density sensory chromaticity)

The heat sensitive recording materials obtained in Examples 1 and 2 and Comparative Examples 1–4 were respectively printed by heat sensitive facsimile printing tester under application of energy of 0.92 mJ and color density of the obtained color images was measured by Macbeth RD918 and sensory chromaticity was measured by a differential colorimeter. The results are shown in Table 1, where $\Delta=[(a^*)^2+(b^*)^2]^{\frac{1}{2}}$ and the smaller value means the image is close to achromatic color and this is desirable state.

Test 2 (heat resistance fog)

The heat sensitive recording materials obtained in Examples 1 and 2 and Comparative Examples 1–4 were left to stand in an atmosphere of 60° C. for 24 hours and then density of the portion which formed no color was measured in the same manner as in Test 1. The results are also shown in Table 1. The smaller value of density of this portion indicates less fog in background and this is desirable state.

TABLE 1

| | Test 1 | | | | | Test 2 |
|---|---|---|---|---|---|---|
| | Back-ground | Color formed portion | a* | b* | Δ | Back-ground |
| Example 1 | 0.07 | 1.15 | 3.44 | 2.58 | 4.30 | 0.10 |
| Example 2 | 0.08 | 1.11 | 3.93 | 2.21 | 4.51 | 0.10 |
| Comparative Example 1 | 0.07 | 1.08 | 9.52 | 1.02 | 9.57 | 0.07 |
| Comparative Example 2 | 0.12 | 1.14 | 5.23 | 3.63 | 6.37 | 0.20 |
| Comparative Example 3 | 0.07 | 1.08 | 6.46 | 1.10 | 6.55 | 0.10 |
| Comparative Example 4 | 0.07 | 1.11 | 6.74 | 1.22 | 6.85 | 0.10 |

a*: chromaticity representing hue
b*: chromaticity representing colorfulness

As mentioned above, heat sensitive recording materials less in fog in background area and excellent in color toning effect can be obtained by adding fluoran compound according to the present invention.

What is claimed is:

1. A heat sensitive recording material comprising a support and provided thereon, a heat sensitive recording layer which contains an aromatic isocyanate compound, an imino compound which has at least one >C=NH group and reacts upon application of heat to form a color and a fluoran compound represented by the formula:

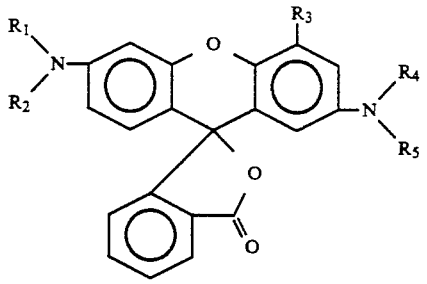

where $R_1$, $R_2$ and $R_3$ each represents a hydrogen atom, a lower alkyl group, a cyclohexyl group or a allyl group and $R_4$ and $R_5$ each represents a hydrogen atom, a lower alkyl group, a phenyl group, a cyclohexyl group or an aralkyl group.

2. A heat sensitive recording material according to claim 1, wherein $R_1$ and $R_2$ each represents a lower alkyl group, $R_3$represents a hydrogen atom or a lower alkyl group and $R_4$ and $R_5$ each represents an aralkyl group in the formula which represents the fluoran compound.

3. A heat sensitive recording material according to claim 1, wherin the fluroran compound is contained in an amount of at least 0.5% by weight of the imino compound.

4. A heat sensitive recording material according to claim 3, wherein the fluoran compound is contained in an amount of 1–100% by weight of the imino compound.

5. A heat sensitive recording material according to claim 1, which additionally contains a heat fusible substance.

6. A heat sensitive recording material according to claim 1, which additionally contains a phenol compound.

7. A heat sensitive recording material according to claim 1, wherein the fluoran is selected from the group consisting of 3-diethylamino-5-methyl-7-dibenzylaminofluoran, 3-diethylamino-7-dibenzylaminofluoran, 3-N-ethyl-N-cyclohexylamino-7-anilinofluoran, 3-N-ethyl-N-(p-methylphenyl)amino-7-(N'-methyl-N'phenylamino) fluoran, 3-pyrrolidyl-7-cyclohexylaminofluoran, 3-diethylamino-7-anilinofluoran, 3-N-ethyl-N-p-methylphenylamino-7anilinofluoran, 3-diethylamino-7-p-cyclohexylanilinofluoran, 3-diethylamino-7-(N-cyclohexyl-N-benzylamino)fluoran, and 3-cyclohexylamino-7-(N-methyl-N-p-methylphenylamino)-fluoran.

* * * * *